US012390680B1

(12) United States Patent
Nolan et al.

(10) Patent No.: US 12,390,680 B1
(45) Date of Patent: Aug. 19, 2025

(54) EXERCISE BENCH AND COMBINATION WITH USER ENGAGEABLE ATTACHMENTS

(71) Applicant: Bulletproof Fitness Equipment Inc, Acton, CA (US)

(72) Inventors: Lawrence R Nolan, Santa Clarita, CA (US); Nicole K. Nolan, Santa Clarita, CA (US); Christopher I. Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 154 days.

(21) Appl. No.: 18/477,011

(22) Filed: Sep. 28, 2023

Related U.S. Application Data

(60) Provisional application No. 63/503,876, filed on May 23, 2023, provisional application No. 63/411,301, filed on Sep. 29, 2022.

(51) Int. Cl.
*A63B 21/00* (2006.01)
*A63B 21/06* (2006.01)

(52) U.S. Cl.
CPC ..... *A63B 21/4031* (2015.10); *A63B 21/0615* (2013.01); *A63B 2208/0233* (2013.01); *A63B 2225/09* (2013.01)

(58) Field of Classification Search
CPC ..... A63B 21/0615; A63B 21/4029; A63B 21/4031; A63B 22/0046; A63B 22/0087; A63B 22/0089; A63B 2208/0228; A63B 2208/0233; A63B 2208/0242; A63B 2208/0252; A63B 2225/09; A63B 2244/09
See application file for complete search history.

(56) References Cited

U.S. PATENT DOCUMENTS

| | | | | |
|---|---|---|---|---|
| 4,635,934 | A * | 1/1987 | Roethke | A63B 23/00 482/104 |
| 4,793,608 | A * | 12/1988 | Mahnke | A63B 21/154 482/142 |
| 6,340,342 | B1 * | 1/2002 | Lee | A63B 23/0355 482/79 |
| 12,280,290 | B2 * | 4/2025 | Wilson | A63B 21/4029 |
| 2019/0329086 | A1 * | 10/2019 | Rindfleisch | A63B 21/0622 |
| 2020/0360764 | A1 * | 11/2020 | Smith | A63B 21/00178 |
| 2023/0173331 | A1 * | 6/2023 | Wilson | A63B 21/00058 482/138 |
| 2023/0264094 | A1 * | 8/2023 | Akeel | A63B 23/03541 482/8 |

* cited by examiner

*Primary Examiner* — Gary D Urbiel Goldner
(74) *Attorney, Agent, or Firm* — AVEK IP, LLC

(57) ABSTRACT

An exercise bench includes a base frame having a left side rail with a channel and a right side rail with a channel, and a support system having a front bar and a rear bar extending substantially parallel to one another; rear angled support bars extending from the rear bar to the left side rail and the right side rail; and front angled support bars extending from the front bar to the left side rail and the right side rail; a mid-frame having wheels for engaging with the channels; a seat frame coupled to the mid-frame; a seat support and a back support each coupled to the seat frame; and receivers extending from one or more of the left side rail, the right side rail, the front bar, and the rear bar; the seat support and the back support are independently adjustable; and the receivers are to receive attachments.

15 Claims, 16 Drawing Sheets

EXERCISE BENCH AND COMBINATION WITH USER ENGAGEABLE ATTACHMENTS

RELATED APPLICATIONS

This application claims priority to U.S. Provisional Application No. 63/411,301, filed Sep. 29, 2022, and U.S. Provisional Application No. 63/503,876, filed May 23, 2023. Both of the foregoing are incorporated by reference in their entireties herein.

FIELD OF INVENTION

The disclosure relates generally to exercise equipment. More specifically, the disclosure relates to an exercise bench with an adjustable seat support and back support, as well as a plurality of receivers, for engaging with user selectable attachments to provide for a diverse and extensive range of exercises for the user. The exercise bench further includes a sliding frame assembly for providing additional adjustability of the exercise bench.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes an exercise bench, including a base frame having a left side rail with a first channel and a right side rail with a second channel, the left and right side rails extending parallel to one another, and the base frame having a support system. The support system includes a front bar and a rear bar extending substantially parallel to one another; one or more rear angled support bars extending from the rear bar to the left side rail and the right side rail; and one or more front angled support bars extending from the front bar to the left side rail and the right side rail. A mid-frame includes a plurality of wheels for engaging with the first channel and the second channel. A seat frame coupled to the mid-frame. A seat support coupled to the seat frame and a back support coupled to the seat frame, the seat support and the back support are independently adjustable. A plurality of receivers extending from one or more of the left side rail, the right side rail, the front bar, and the rear bar, the plurality of receivers are configured to receive user selectable attachments.

In yet another embodiment of the current disclosure, the invention includes a combination of an exercise bench and a user attachment system. The exercise bench includes a base frame having a left side rail with a first channel and a right side rail with a second channel, the left and right side rails extending parallel to one another, and the base frame having a support system. The support system includes a front bar and a rear bar extending substantially parallel to one another, one or more rear angled support bars extending from the rear bar to the left side rail and the right side rail, and one or more front angled support bars extending from the front bar to the left side rail and the right side rail. A mid-frame includes a plurality of wheels for engaging with the first channel and the second channel. A seat frame coupled to the mid-frame. A seat support coupled to the seat frame and a back support coupled to the seat frame, the seat support and the back support are independently adjustable. A plurality of receivers extend from one or more of the left side rail, the right side rail, the front bar, and the rear bar. The user attachment includes a connector for engaging with one or more of the plurality of receivers; and one or more user engageable devices coupled to the connector, wherein the one or more user engageable devices are configured to be engaged by the user during an exercise.

BRIEF DESCRIPTION OF THE DRAWINGS

Embodiments of the invention are described in detail below with reference to the attached drawings.

Figure 1:
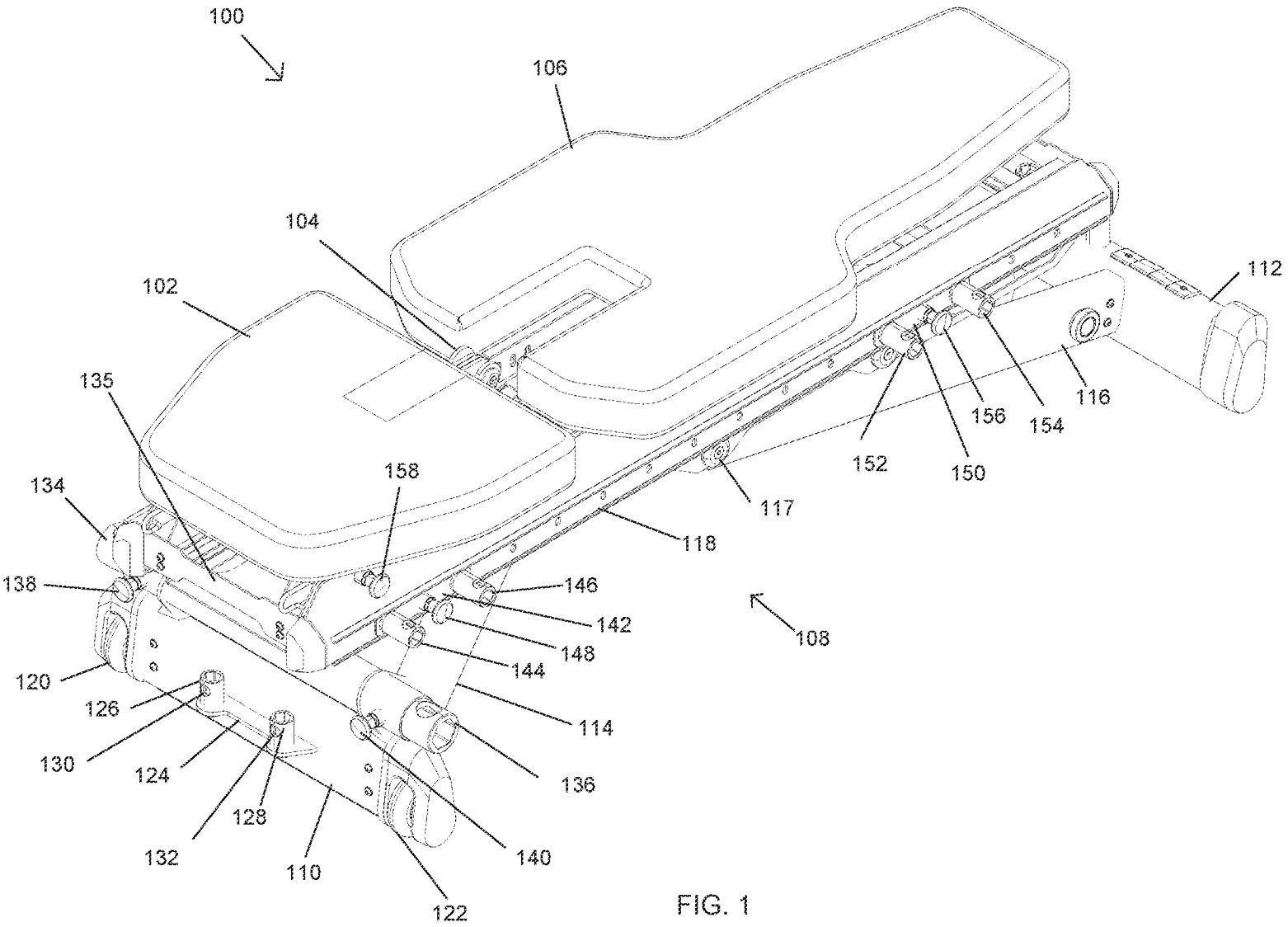
FIG. 1 is a top angled perspective view of an exercise bench from a first side in accordance with the present invention.

The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on their needs. Those skilled in the art will recognize that adjustability and diversity in exercise equipment is desirable. In addition, the ability to utilize one machine or device for multiple exercises, is desirable. Adjustability and diversity are key for the user to get the best workout, with the least amount of equipment, and taking up the smallest footprint. This is desirable for both gym and home equipment, as space and resources are never unlimited.

Accordingly, the present invention provides for an exercise bench with a seat support and a back support, each being independently adjustable in multiple ways. The exercise bench includes a plurality of receivers at a plurality of different locations for allowing user selectable attachments to be attached to the exercise bench, such that the user can complete a plurality of different exercises with the bench as the primary support system. For example, the user may adjust an angle and position of the seat support and back support, add a foot plate attachment, and add a pair of shoulder attachments, and complete a first workout. Then the user may again adjust and change the positioning and angles of the seat support and back support, remove the foot plate attachment and pair of shoulder attachments, and proceed to adding a pair of chest engaging attachments, and complete a second workout. This process can continue over the workout to provide the user with an extremely diverse and complete workout all while utilizing the same core bench described herein. The present invention further includes a sliding frame assembly comprising a base frame, a mid-frame, and a seat frame, wherein the mid-frame is coupled to the base frame and can traverse relative to the base frame, and the seat frame is coupled to the mid-frame and can transverse relative to the mid frame. Accordingly, the mid-frame can be allowed to move freely, or locked in place, as so too can the seat frame. Again, these features allowing for additional flexibility in use.

Figure 2:
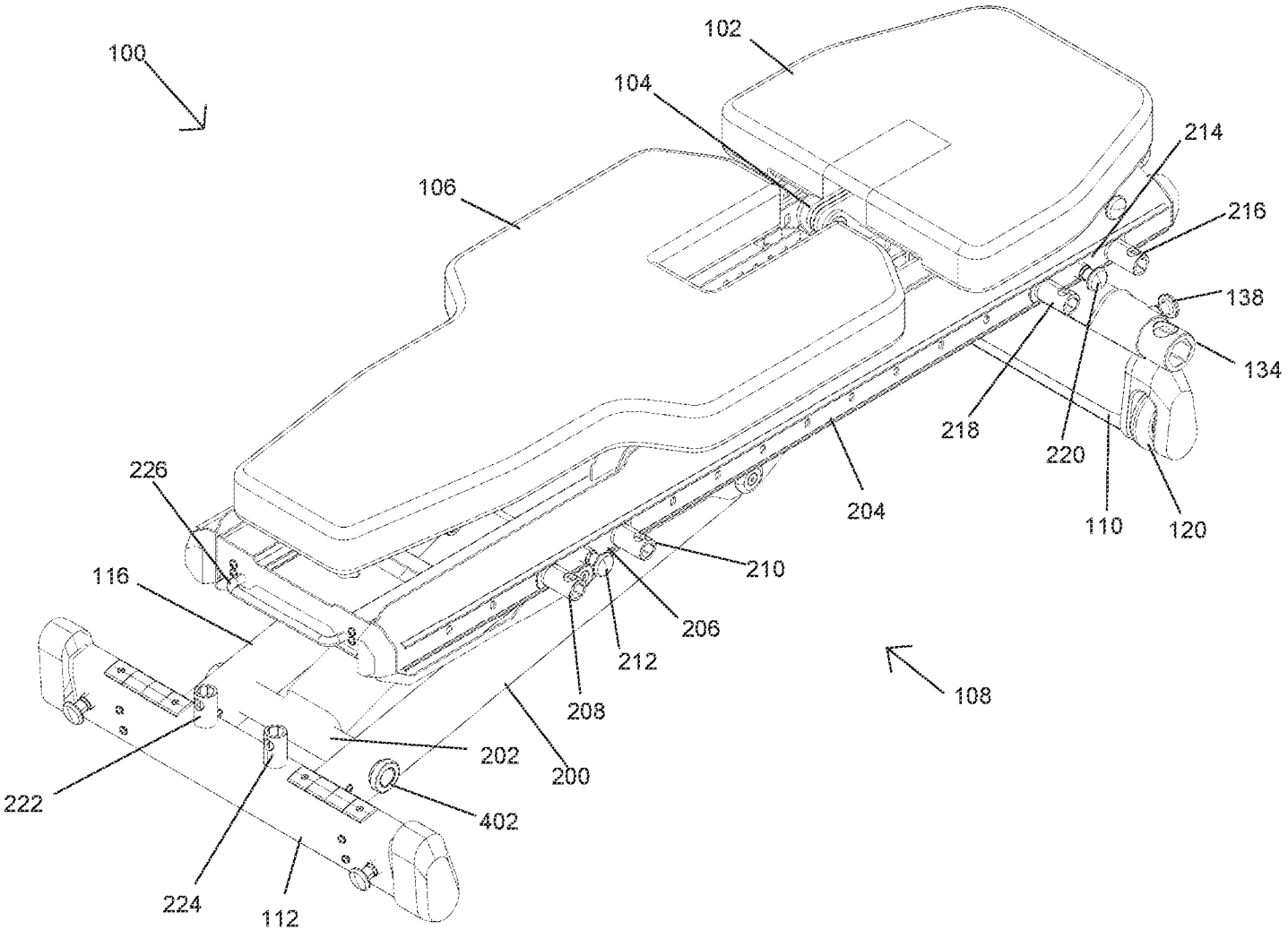
FIG. 2 is another top angled perspective view of the exercise bench of FIG. 1 from a second side.
Figure 3:
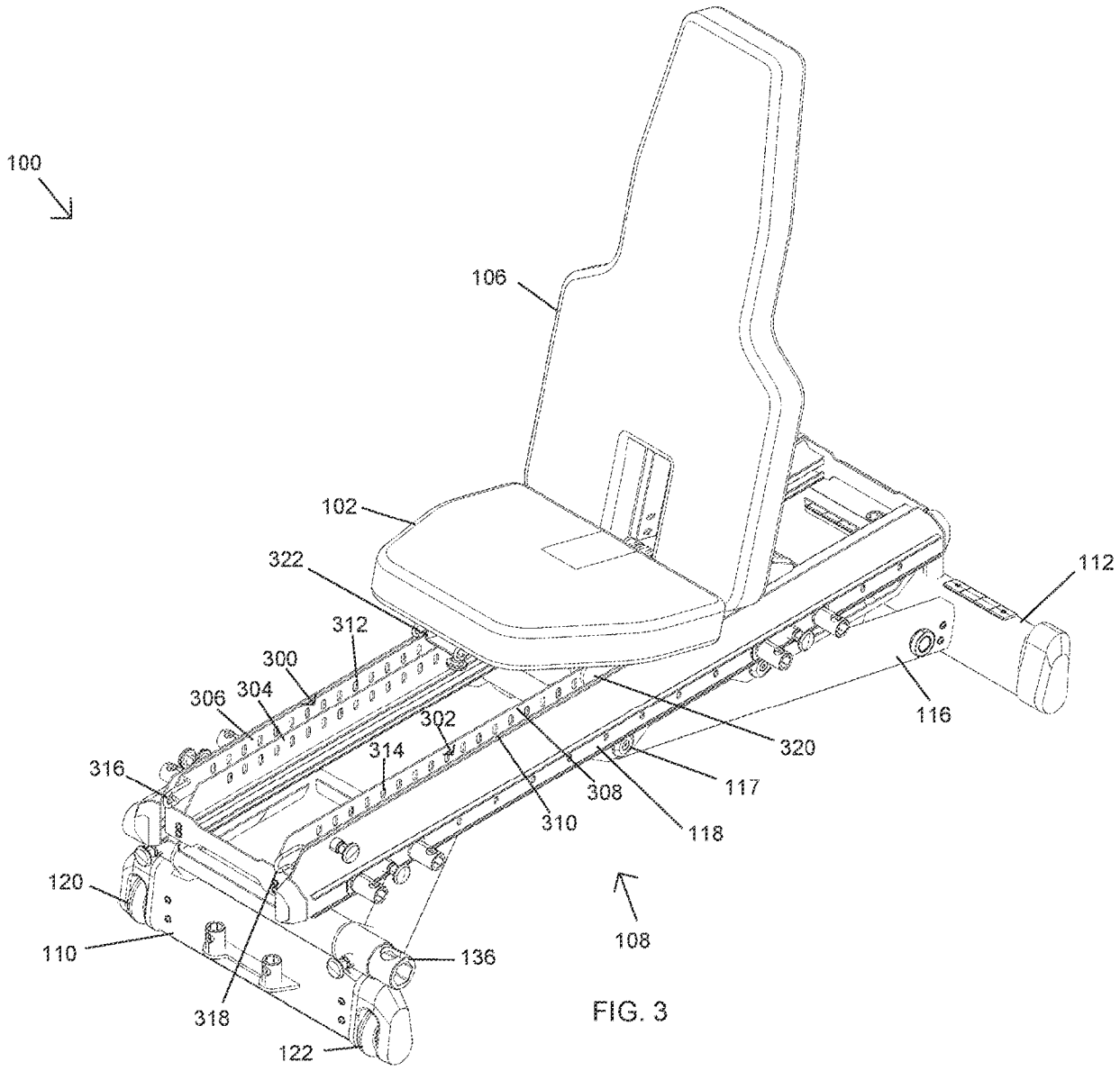
FIG. 3 is another perspective view of the exercise bench of FIG. 1 with a seat support and a back support in second positions.
Figure 8:
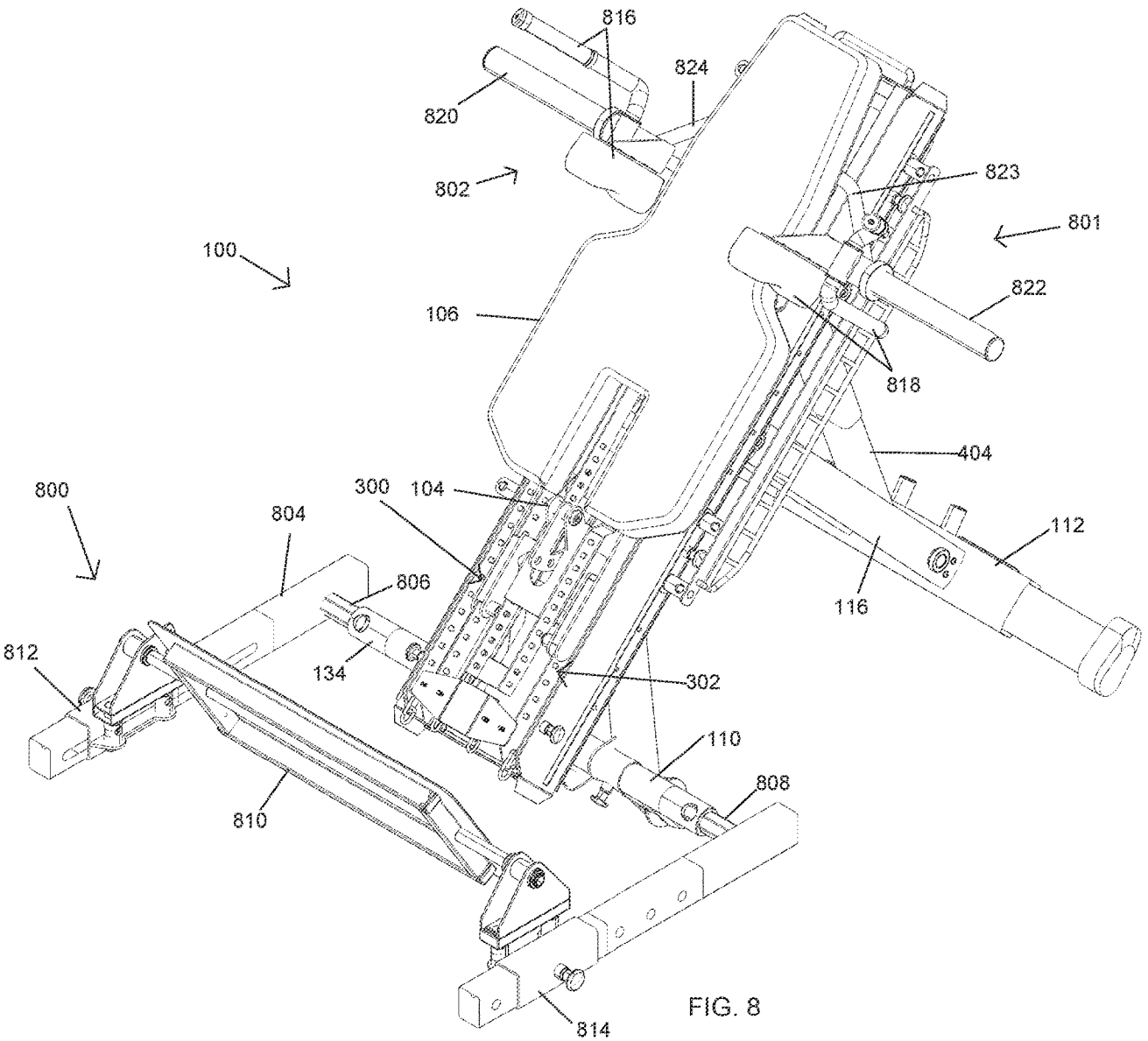
FIG. 8 is another perspective view of the exercise bench of FIG. 1 with the seat support removed, a foot plate attachment, and a pair of shoulder attachments.

FIGS. 1 and 2 depict the exercise bench 100 from a first side and a second side. The bench 100 includes the seat support 102 and the back support 106 which are composed of a padded structure to support the user's body thereon. The exact shape and size of these supports 102, 106 can vary as would be understood by those skilled in the art. The supports 102, 106 are each also engaged with a pivot connection 104 which allows for the angle of the supports 102, 106 to be adjusted. The pivot connection 104 is best shown in FIG. 8. For example, as shown in FIG. 3, the back support 106 may be raised to a substantially seated position. In addition, the seat support 102 may be angled upwards as desired or needed by the user.

A support system 108 rests on a ground surface and provides structural integrity for the bench 100. The support system 108 includes a front support bar 110 and a rear support bar 112 which are positioned substantially parallel to one another and rest on the ground surface. Rear angled support bars 116, 200 extend from the rear support bar 112. A cross bar 202 is positioned between the rear angled support bars 116, 200 and is engaged therewith via a hinge 402. Similarly, front angled support bars 114 extend from the front support bar 110. In embodiments, wheels 120, 122 are attached to the front support bar 110 to allow for easy movement of the exercise bench 100. For example, a user may tilt the bench 100 upwards such that the entire weight of the bench 100 is supported by the wheels 120, 122 and then proceed to move the bench 100. As part of a base frame 1301, discussed later herein, is a right side rail 118 and a left side rail 204 which extend parallel to one another and allow for additional modifications to the bench 100. One or more handles 226 allow for easy user manipulation of the bench 100. Those skilled in the art will appreciate that all of the support system 108 components may vary in materials, have size modifications, and the like without departing from the present invention.

Figure 9:
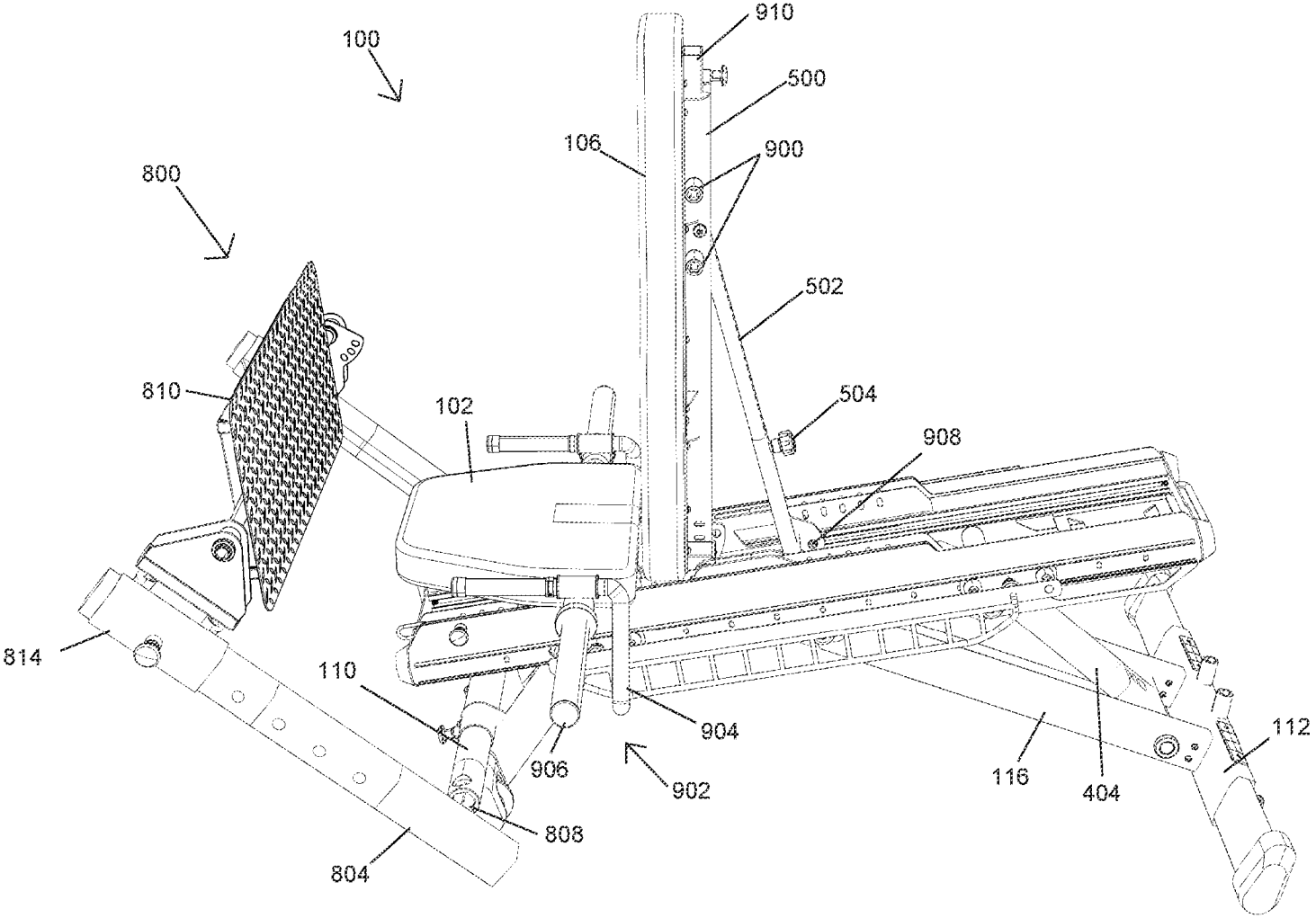
FIG. 9 is a side view of the exercise bench of FIG. 1 with the foot plate attachment, and a fourth pair of attachments.

The bench 100 includes a plurality of receivers to allow for user selectable attachments (shown in FIGS. 6-12). As shown, a front attachment bracket 124 extends from the front support bar 110 and supports receivers 126, 128, which extend upwards and include apertures 130, 132 for receiving pins or other securement devices (not shown). Accordingly, a user selectable attachment can secure to the front support bar 110. A plurality of rail attachments 142, 150, 206, 214 are selectively positioned along the rails 118, 204 as shown. Said rail attachments 142, 150, 206, 214 are adjustable in position via pins 148, 156, 212, 220 within the associated rails 118, 204 and further include additional rail receivers 144, 146, 152, 154, 208, 210, 216, 218 for receiving attachments. Accordingly, a user can adjust a position of one or more of the rail attachments to then receive a user selectable attachment. Such adjustability is critical for users of varying heights, and for use of the bench 100 with a plurality of exercises. Yet further, rear receivers 222, 224 extend upward from the rear support bar 112 for engaging with attachments. Again, apertures allow for engagement with pins or other securement devices to lock attachments therein. Yet further, side receivers 134, 136 with pins 138, 140 extend outwardly and to the sides for additional attachment locations. The side receivers 134, 136 may be at least partially supported by the front bar 110. And lastly, as best shown in FIG. 9, back receivers 900 may extend from a back brace 500. The back receivers 900 may be in pairs and extend from both sides, although only one side is shown. In embodiments, all or some of the receivers are hexagonal in shape to provide a secure fit to insert connectors associated with the various attachments. Hexagonal connections ensure that the connectors and receivers are locked together and rotational movement is prevented.

As best shown in FIG. 3, the bench 100 includes a left side track 300 and a right side track 302, each track consisting of a first side and a second side. Namely, left side track 300 includes a first side 304 and a second side 306, each with a plurality of apertures 312. Similarly, the right side track 302 includes a first side 308 and a second side 310, each with a plurality of apertures 314. The side tracks 300, 302 are part of a mid-frame 1302, discussed in FIG. 3, and provide for locations to lock the mid-frame 1302 at a position relative to the base frame 1301. Similarly, the tracks 300, 302 provide locations to lock the seat frame 1304 relative to the mid-frame. Such locking is accomplished via pins, or similar securement devices, as would be understood by those skilled in the art. Also shown best in FIG. 3, are two end rings 316, 318 which extend into the associated tracks. These end rings 316, 318 may provide a variety of functions such as additional attachment locations for accessories. These features are particularly useful for pushing exercises, such as leg press, as shown in FIG. 9, and offer users options for cable resistance in addition to weight plate resistance.

Figure 4:
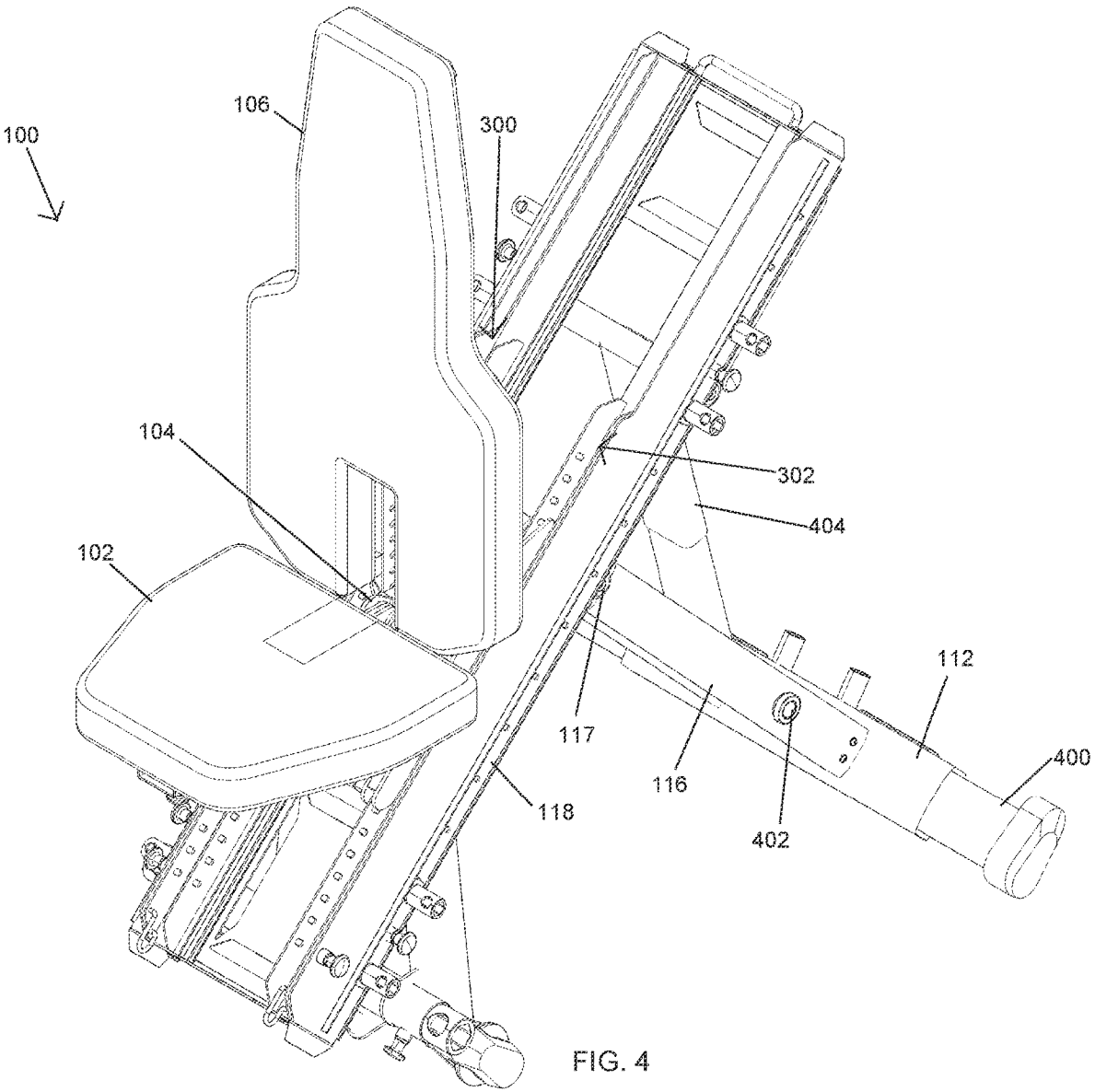
FIG. 4 is another perspective view of the exercise bench of FIG. 1 with the seat support and back support in third positions.
Figure 5:
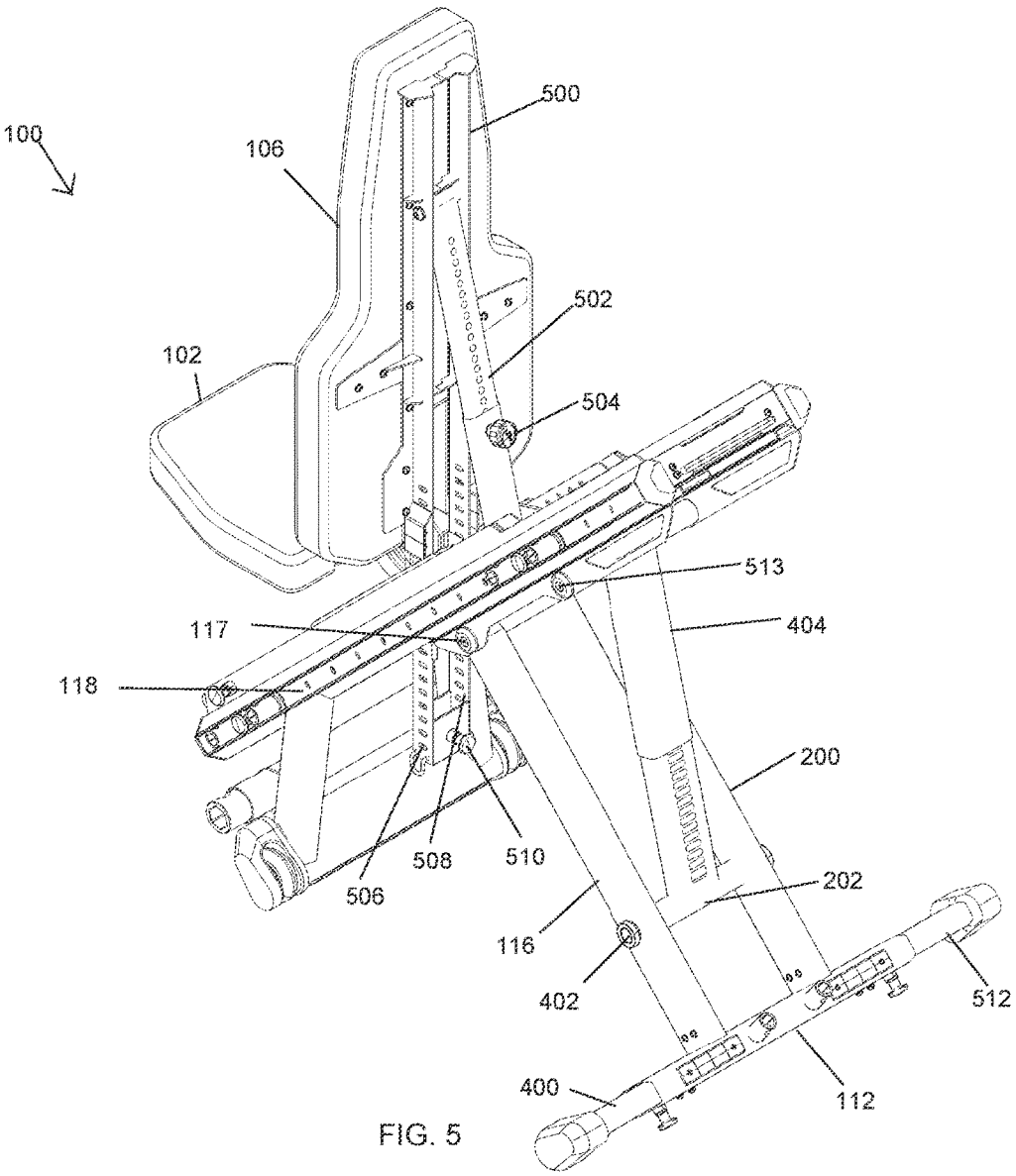
FIG. 5 is another perspective view of the exercise bench of FIG. 1 with the seat support and the back support in the position of FIG. 4, from another angle.

Turning now to FIGS. 4 and 5, the bench 100 is shown in an adjusted position. Namely, the back support 106 is pivoted upwards such that it may support the user in a substantially seated position. The rear angled support bars 116, 200 are coupled to the left side rail 204 and the right side rail 118 via a hinge 117. This allows for rear bar 112 to pivot underneath of the back support 106 as shown in FIGS. 4 and 5. The cross bar 202 extends between the first angled support bar 116 and the second angled support bar 200 and is also coupled to the first angled support bar 116 and the second angled support bar 200 bar via another hinge 402. An adjustable support bar 404 is attached to the cross bar 202 and extends to the left side rail 204 and the right side rail 118 and again is attached thereto via another hinge 513, the adjustable support bar 404 is adjustable in length. Accordingly, this configuration allows for the left and right side rails 204, 118 to be raised at an angle, as shown, while the rear bar 112 remains on the ground.

Also shown best in FIG. 5 is a back brace 500 which is secured to an underneath side of the back support 106. The back brace 500 provides a location to attach an adjustable bar 502 with pin 504. The adjustable bar 502 extends therefrom and engages at a pivot connection 908 (see FIG. 9) positioned between the left side rail 204 and the right side rail 118. Accordingly, the left and right side rails 204, 118 can be raised up to an angle, and then the back support 106 can also be adjusted at an angle relative to the left and right side rails 118, 204. Further, a dual rail system 506, 508 is attached to and extends downward from the back brace 500. The dual rail system 506, 508 allows for height adjustment of the back support 106. In embodiments, a pin 510 is provided for engaging with attachments, as part of connections 1026 and 1122, discussed in reference to FIGS. 10 and 11. This combination of features allows for extensive customization by a user depending on an exercise they desire to perform.

Also shown best in FIG. 5, the rear bar 112 supports two extension legs 400, 512 that extend and contract outward and inward. Such adjustment can allow a user to extend the legs 400, 512 out for improved stability, and inward for limited floor space or storage.

FIGS. 6 through 12 depict a plurality of examples of attachments for use with the bench 100. These attachments are shown and intended as examples, and those skilled in the art will appreciate that additional attachments may be developed with the teachings discussed in the present disclosure.

Figure 6:
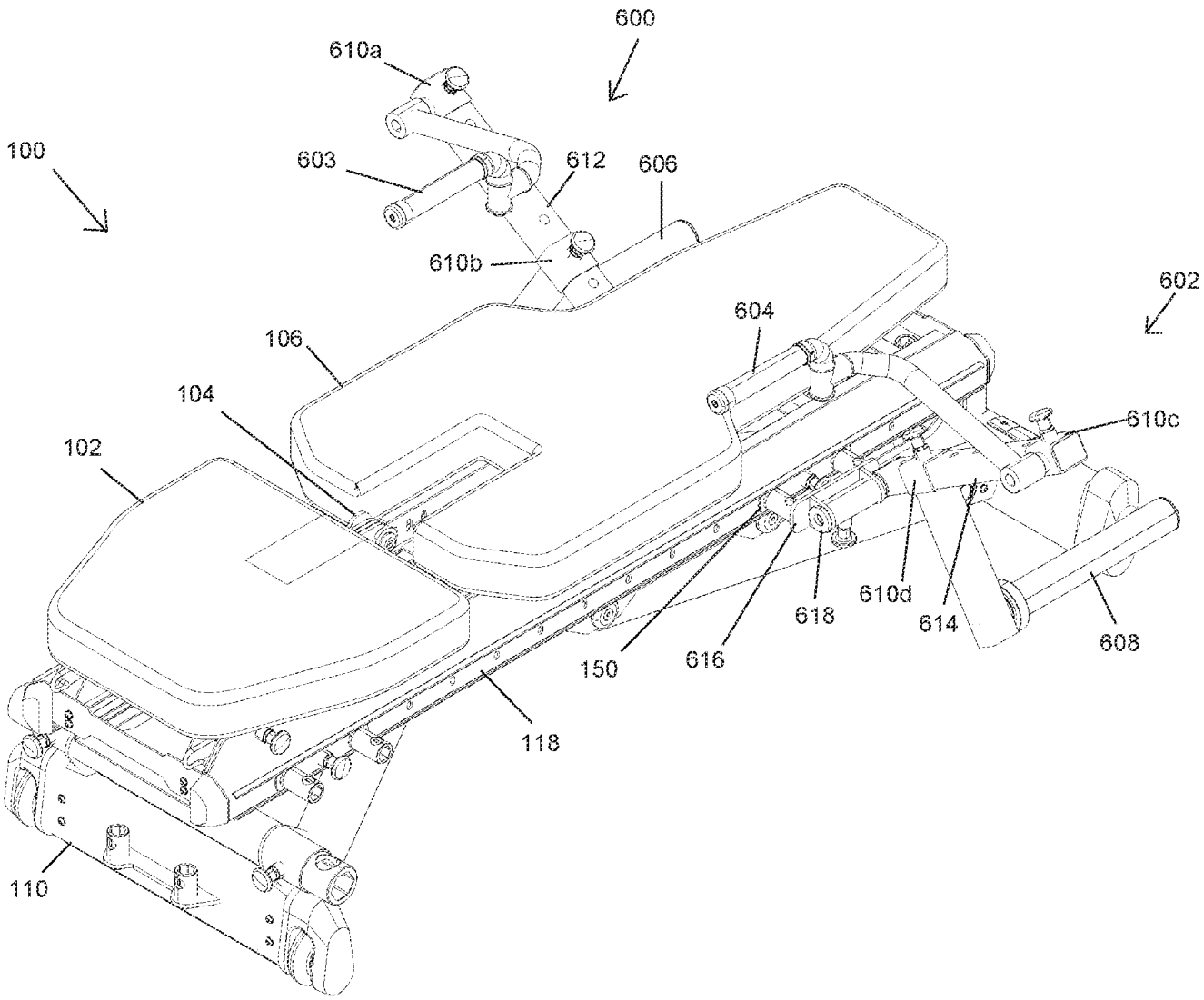
FIG. 6 is another perspective view of the exercise bench of FIG. 1 with a first pair of attachments.

FIG. 6 shows a first pair of attachments 600, 602, each independently coupled to one of the rail attachments discussed above. Accordingly, a position along an associated rail can be adjusted. In other words, as rail attachment 150 is adjusted along rail 118, so too is the associated attachment 602. This adjustment can allow for use of the bench and attachment combination by users of varying heights, as well as for engagement by varying muscle groups. The attachments 600, 602 each include an associated connector, example connector 616, for engaging with the receivers extending from the associated rail attachment, example rail attachment 150. Rotational joints, example rotational joint 618, couple the connectors to associated arms 612, 614. The arms 612, 614 then support adjustable carriages 610*a-d*, which further support handles 603, 604 and weight receivers 606, 608. The attachment pair 600, 602 can be used for chest exercises, such as fly curls.

Figure 7:
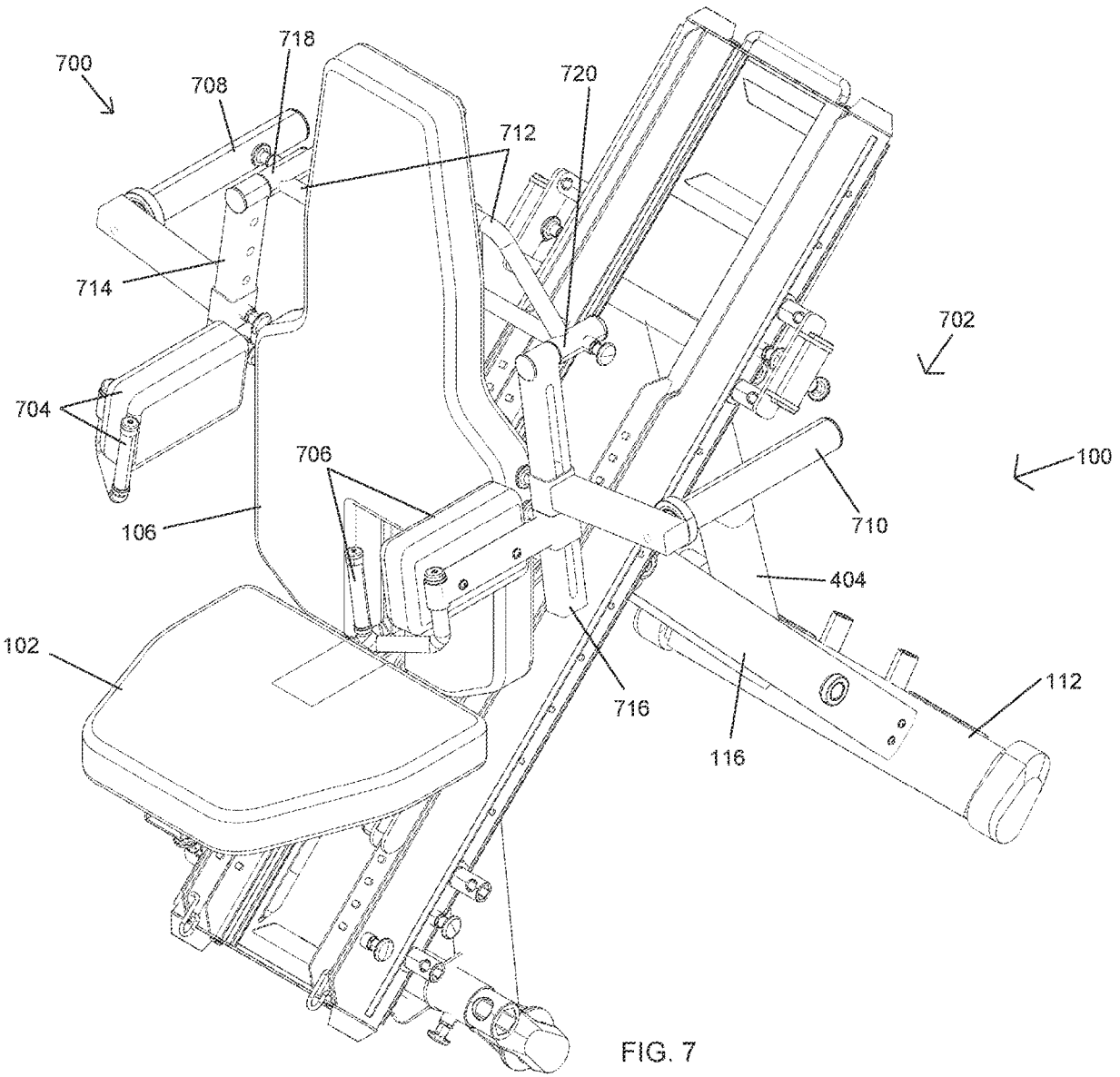
FIG. 7 is another perspective view of the exercise bench of FIG. 1 with a second pair of attachments.

FIG. 7 depicts a second pair of attachments 700, 702, each having a pad/handle combination 704, 706. The pad/handle combinations 704, 706 are each coupled to an associated arm 714, 716. Each arm 714, 716 further supports a weight receiver 708, 710. Again, carriages are used to allow for adjustability of the weight receivers and pad/handle combinations. The arms are coupled to connectors 712 via rotational joints 718, 720. Although not shown in FIG. 7, those skilled in the art will appreciate that the connectors 712 extend to back receivers 900 as shown best in FIG. 9. The pair of attachments 700, 702 allows for lateral shoulder exercises.

In FIG. 8, another pair of attachments 801, 802 are shown. Similar to the pair of attachments 700, 702 of FIG. 7, this pair 801, 802 includes combination pad/handles 816, 818, weight receivers 820, 822, and connectors 823, 824. The orientation of the pad/handles 816, 818 is configured for engaging with a top of the user's shoulder, such as for a hack squat style exercise. FIG. 8 also shows a foot plate attachment 800, having a floor support 804, which again may be adjustable. The floor support 804 is coupled to connectors 806, 808 that are then coupled to receivers 134, 136 as shown. A foot plate 810 is coupled to the floor support 804 via carriages 813, 814 to again accommodate users of varying heights and needs. In this particular embodiment, the seat support is removed, leaving just the back support 106. Accordingly, the user can rest on the back support 106 and as they complete squatting exercises, the back support 106 will glide along the tracks 300, 302 to accommodate the movement of use user.

FIG. 9 depicts a side view showing another configuration with the foot plate attachment 800. Here, the seat support 102 is reattached with the back support 106 positioned at a desired angle via the adjustable bar 502, pin 504, back brace 500, and pivot connection 908. The seat support 102 is engaged with the tracks such that the user can push against the foot plate 810 and glide backwards along the tracks. Further, an additional weight attachment 902 with one or more weight receivers 906 and one or more handles 904 can be used for support and to add weighted resistance.

Figure 10:
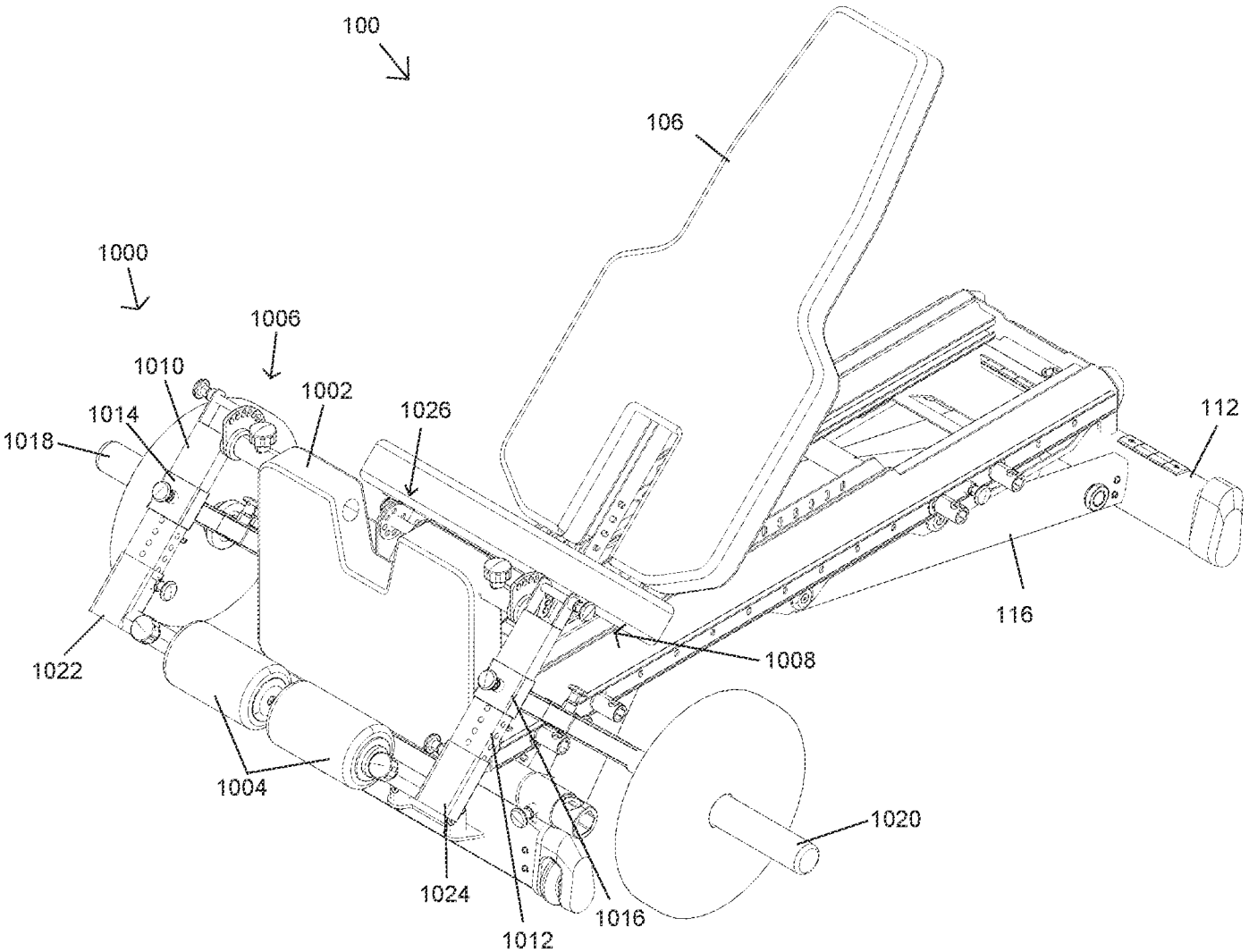
FIG. 10 is a perspective view of the exercise bench of FIG. 1 with a fifth attachment.

In FIG. 10, another attachment 1000 is shown. Here, a first leg pad 1002 is positioned such that a user's legs will rest thereon, while engaging with additional leg pads 1004 such as for leg extensions. Connection systems 1006, 1008 extend from the first leg pad 1002 and couple to arms 1010, 1012. Said arms 1010, 1012 support weight receivers 1018, 1020 via carriages 1014, 1016 and further extend o the leg pads 1004 via carriages 1022, 1024. Here, a connection system 1026 connects the attachment 1000 to the bench. Referring back to FIG. 3, the connection system 1026, in embodiments, is a frame mounted shaft and pin combination 322. As discussed above, the user can make any number of adjustments to the bench and attachment 1000 to support their height, fitness level, or the like.

Figure 11:
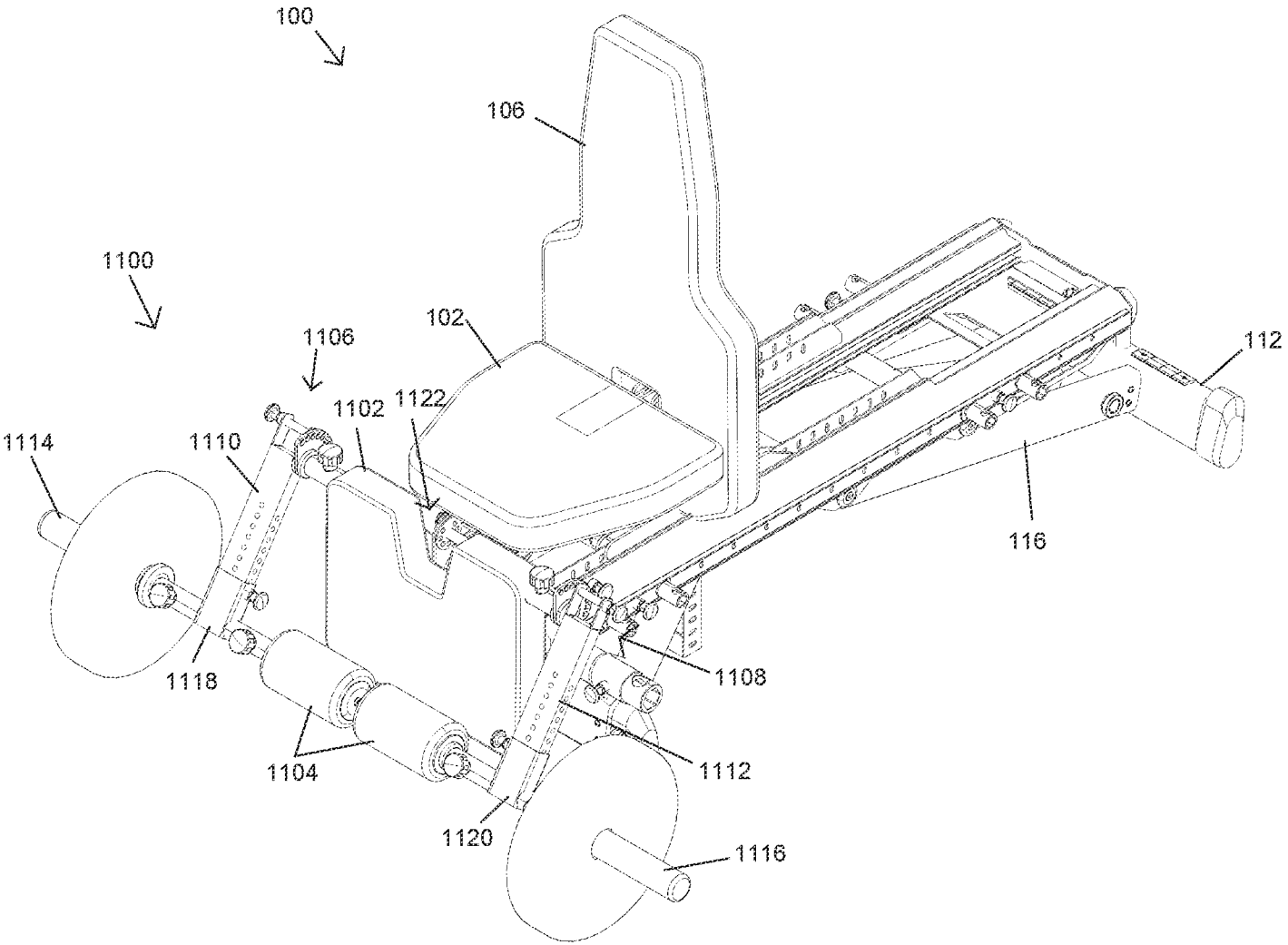
FIG. 11 is a perspective view of the exercise bench of FIG. 1 with a sixth attachment.

In FIG. 11, another attachment 1100 is shown. Similar to attachment 1000, a first leg pad 1102 supports connection systems 1106, 1108 to couple to arms 1110, 1112. The arms 1110, 1112 coupled to additional pads 1104 and weight receivers 1114, 1116 via carriages 1118, 1120. Further, a connection system 1122, which again can be a frame mounted shaft and pin combination, secures the attachment 1100 to the bench 100.

Figure 12:
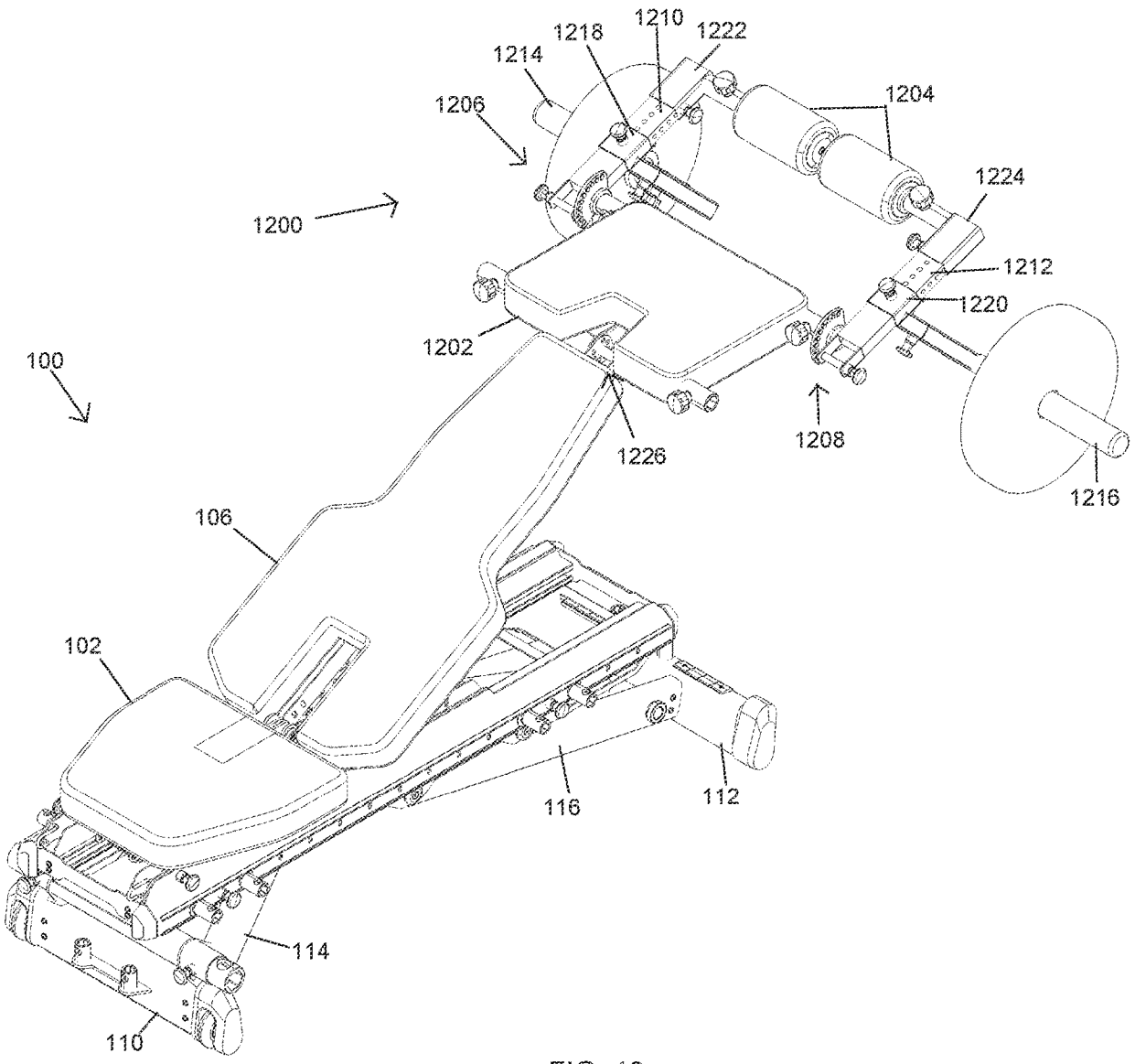
FIG. 12 is a perspective view of the exercise bench of FIG. 1 with a seventh attachment.

In FIG. 12, another attachment 1200 is shown. Similar to attachments 1000, 1100, a first pad 1202 supports connection systems 1206, 1208 to couple to arms 1210, 1212. The arms 1210, 1212 each independently support additional pads 1204 and weight receivers 1214, 1216 via a series of carriages 1218, 1222, 1220, 1224. And lastly, a connection system 1226 connects the attachment to the bench 100. Connection system 1226, as shown in FIG. 9, may be a frame mounted shaft an pin combination 910.

Figure 13:
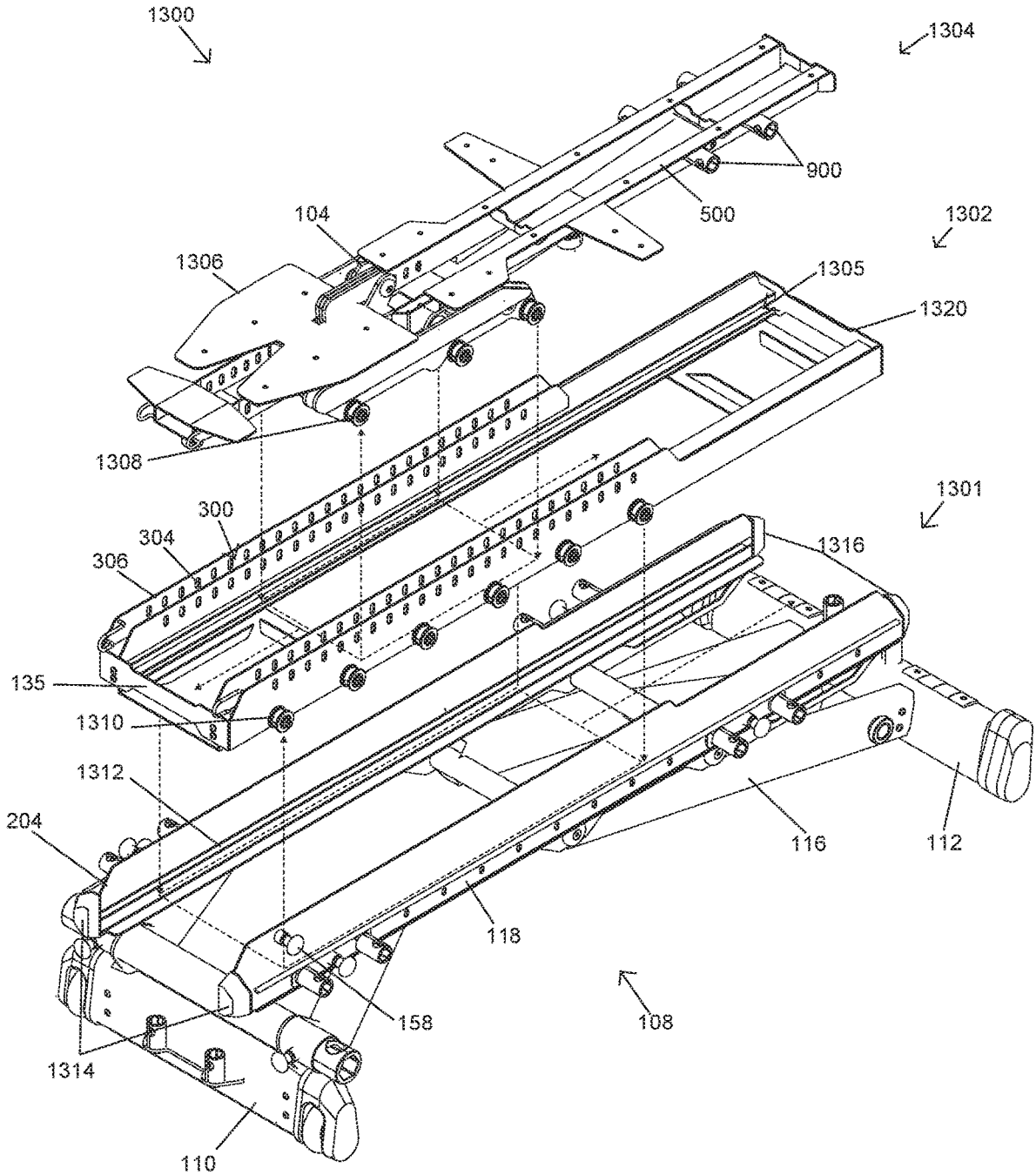
FIG. 13 is a perspective disassembled view of a sliding frame assembly consisting of a base frame, a mid-frame, and a seat frame as part of the exercise bench of FIG. 1.
Figure 14:
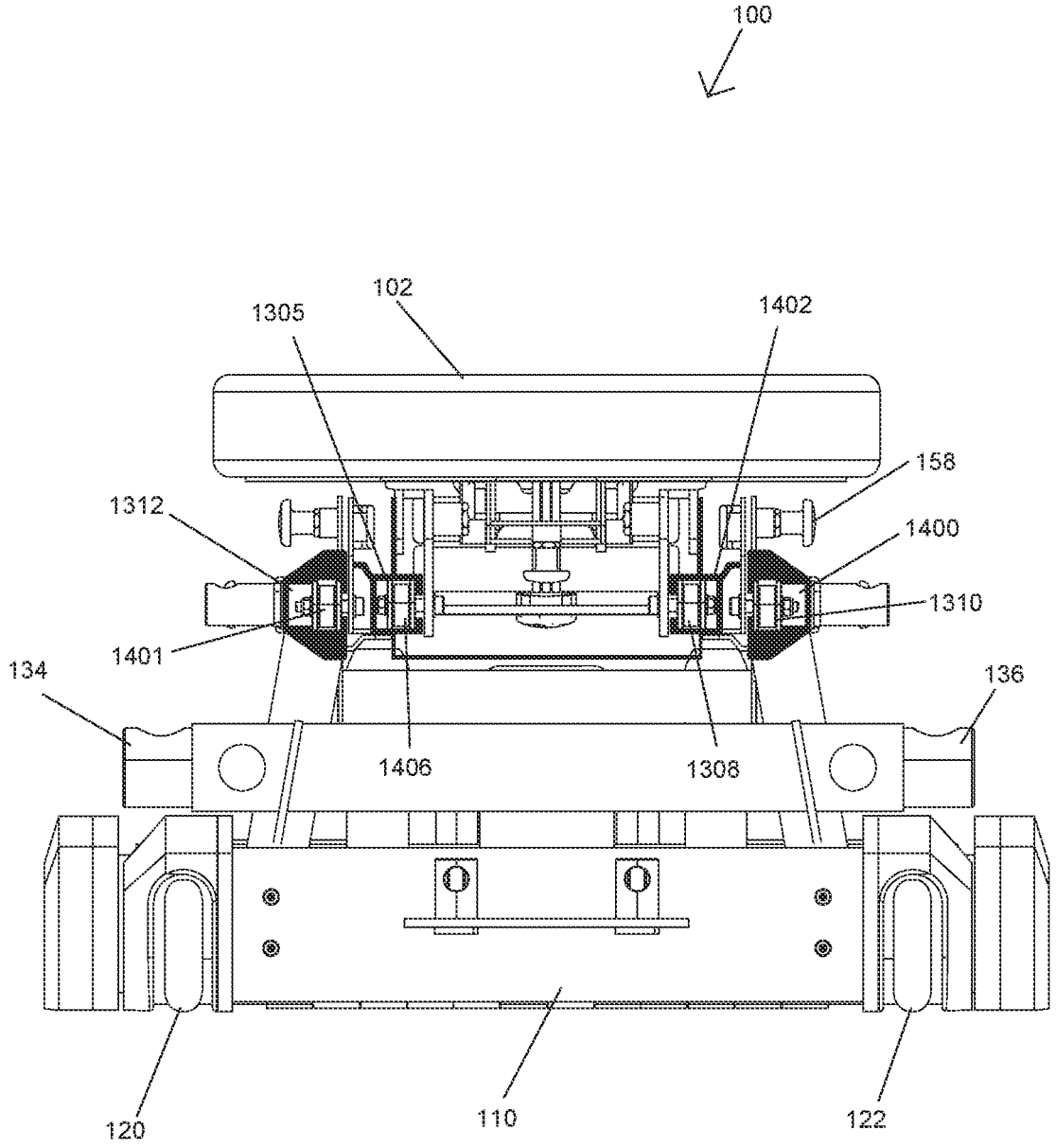
FIG. 14 is a front assembled view of the sliding frame assembly consisting of the base frame, the mid frame, and the seat frame as part of the exercise bench of FIG. 1.

Turning now to FIGS. 13 and 14, a sliding frame assembly 1300 as part of the exercise bench 100 is shown in a disassembled view and an assembled view respectively. The sliding frame assembly 1300 allows for adjustability of the bench 100 and includes features previously discussed. A base frame 1301 includes, among other components, the support system 108 with the front support bar 110, rear support bar 112, rear angled support bar 116, and side rails 118, 204. The base frame 1301 includes the side rails 118, 204 which each have associated channels 1312, 1400 that receive wheels 1310, 1401 of a mid-frame 1302. The connection between the mid-frame 1302 and the base frame 1301 via the wheels 1310, 1401 and channels 1312, 1400 allow for the mid frame 1302 to traverse forward and backward relative to the base frame 1301. Bumpers 1314, 1316 are positioned on ends of the channels 1312, 1400 to prevent the wheels 1310 from disengaging. In other words, the mid frame 1302 cannot roll out from connection with the base frame 1301 due at least in part to the bumpers 1314, 1316. Pins, for example pin 158, can extend through apertures of tracks 300, 302 to lock the mid-frame 1302 relative to the base frame 1301. In embodiments, pin 158 is specifically a spring-loaded lock-out pin to either lock or unlock the mid-frame.

The mid-frame 1302 comprises the left and right tracks 300, 302 supporting associated wheels 1310, 1401 and further creating secondary channels 1305, 1402. The secondary channels 1305, 1402 are configured to receive wheels 1308, 1406 as part of a seat frame 1304. The seat frame 1304 configured to traverse along the mid-frame 1302 via the wheels and channels. Again, bumpers 135, 1320 close off ends of the secondary channels 1305, 1402. As shown, the seat frame 1304 comprises, among other components, the back brace 500 with receivers 900 and a seat brace 1306. Further, as would be understood by those skilled in the art, the seat frame 1304 can lock into place via a locking pin.

Accordingly, both the mid-frame 1302 and the seat frame 1304 can either be locked into place or allowed to traverse back and forth based on the user movements.

Figure 15:
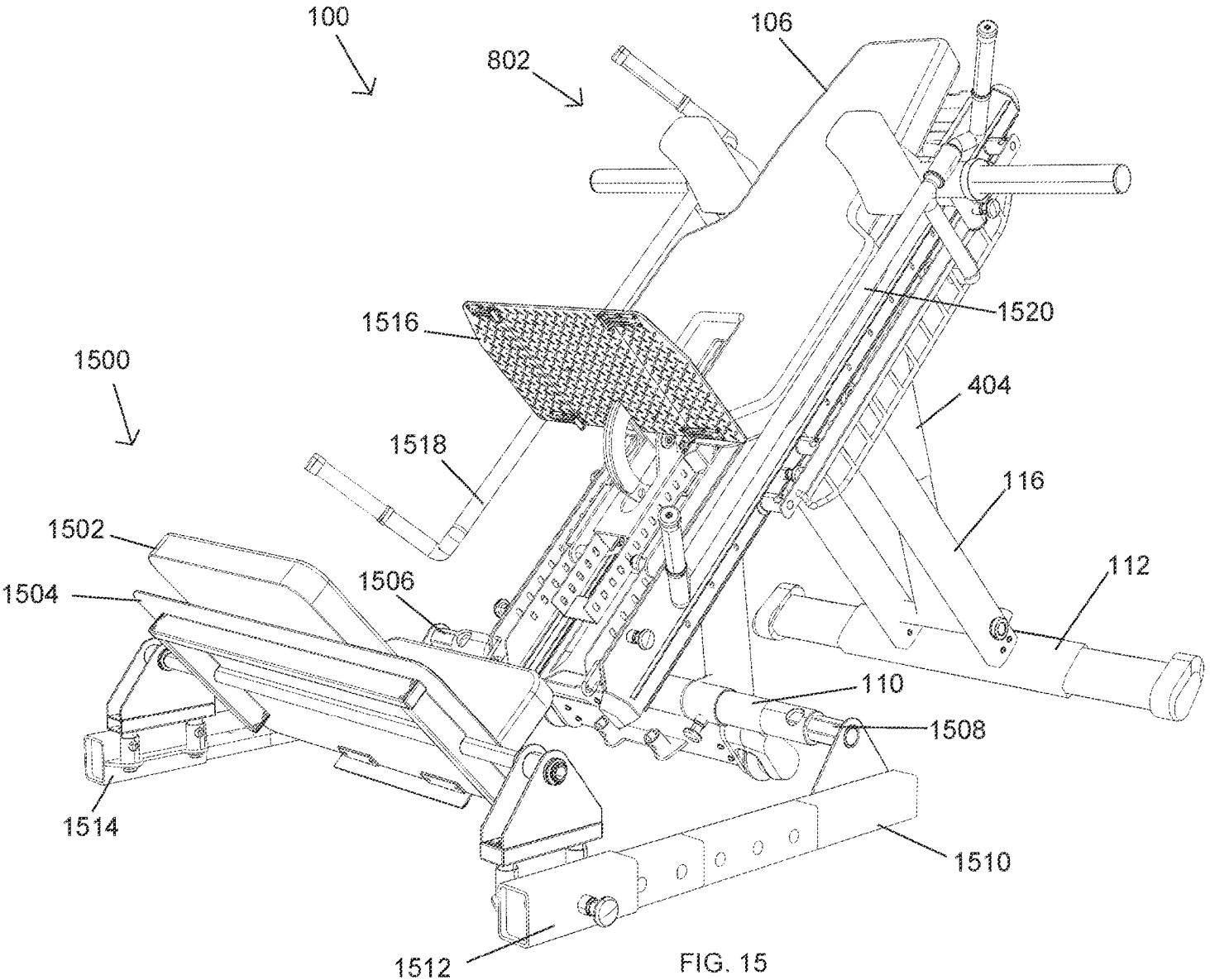
FIG. 15 is a perspective view of the exercise bench of FIG. 1 with an eighth attachment in a first position.
Figure 16:
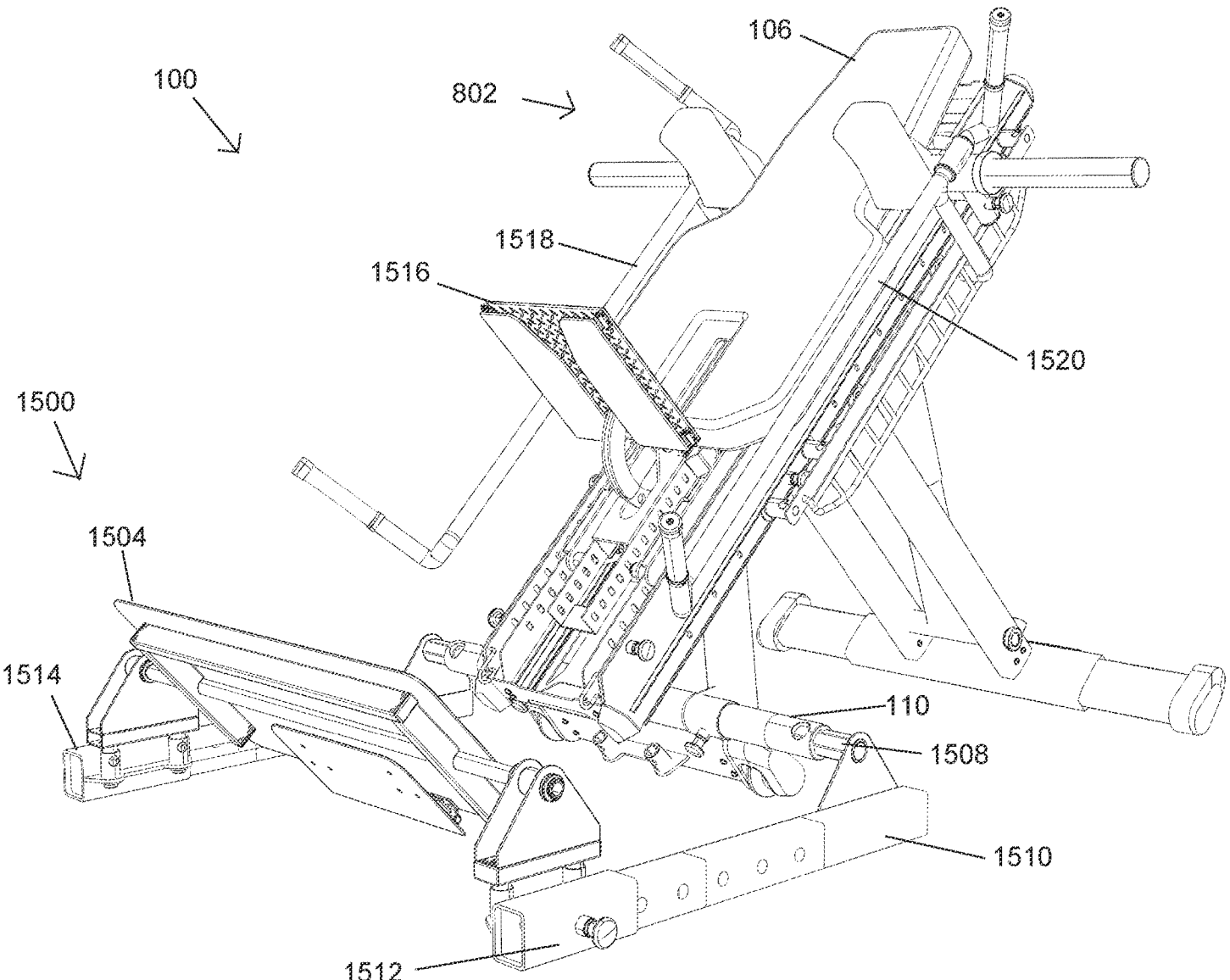
FIG. 16 is a perspective view of the exercise bench of FIG. 1 with the eighth attachment in a second position.

In FIGS. 15 and 16, another attachment 1500 is shown as configured for a leg press. As shown, the upper attachment 802 as describe above may be included. In this configuration, a leg press attachment 1500 includes a body support system 1502 with a base plate 1504 and attached to the front support bar 110 via connectors 1508, 1506. The body support system 1502 is a padded seat support configured to support the user thereon, wherein the user can then engage with a foot press 1516. A base support 1510 supports the body support system 1502 via carriages 1512, 1514. As shown in FIG. 16, the foot press 1516 is configured to fold into a compact configuration for storage.

Pivoting latch systems 1518, 1520 utilizes dual handles for ease of use in both hack squat and leg press configurations, the pivoting latch systems 1518, 1520 each include an extension hook that locks the sliding frame such that a user can lock and unlock the body support 106 into a sliding and locked configuration.

Those skilled in the art will appreciate that although the term "pin" is used to identify a plurality of components, these components can readily be understood as any style or combination of pin, bolt, screw, bar, or other device that provides the same functions discussed herein.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. An exercise bench, comprising:

a base frame having a left side rail with a first channel and a right side rail with a second channel, the left and right side rails extending parallel to one another, and the base frame having a support system, the support system having:

a front bar and a rear bar extending substantially parallel to one another;

one or more rear angled support bars extending from the rear bar to the left side rail and the right side rail; and one or more front angled support bars extending from the front bar to the left side rail and the right side rail;

a mid-frame having a plurality of wheels for engaging with the first channel and the second channel;

a seat frame coupled to the mid-frame;

a seat support coupled to the seat frame;

a back support coupled to the seat frame; and a plurality of receivers extending from one or more of the left side rail, the right side rail, the front bar, and the rear bar;

wherein the seat support and the back support are independently adjustable; and wherein the plurality of receivers are configured to receive user selectable attachments.

2. The exercise bench of claim 1, wherein the mid-frame further comprises:

a left track supporting a first set of the plurality of wheels; and a right track supporting a second set of the plurality of wheels;

wherein the left track and the right track each include a plurality of apertures configured to allow a locking pin to lock the mid-frame at a position relative to the base frame.

3. The exercise bench of claim 2, wherein the mid-frame further comprises:

a first secondary channel; and a second secondary channel.

4. The exercise bench of claim 3, wherein the seat frame further comprises a second plurality of wheels for engaging with the first secondary channel and the second secondary channel such that the seat frame can traverse relative to the mid-frame.

5. The exercise bench of claim 1, further comprising:

one or more wheels coupled to the front bar.

6. The exercise bench of claim 1, wherein the plurality of receivers further comprises:

one or more front receivers attached to the front bar via a bracket, the one or more front receivers extending upward from the bracket and the bracket attached substantially perpendicular to the front bar; and one or more rear receivers attached to the rear bar and extending upward from the rear bar.

7. The exercise bench of claim 1, wherein the plurality of receivers further comprises:

a first side receiver extending to a right side of the exercise bench; and a second side receiver extending to a left side of the exercise bench.

8. The exercise bench of claim 1, wherein the plurality of receivers further comprises:

one or more rail receivers; and a rail attachment engaged with one of the right side rail or the left side rail, the rail attachment configured to traverse along the one of the right side rail or the left side rail;

wherein the one or more rail receivers extends from the rail attachment.

9. The exercise bench of claim 1, wherein the plurality of receivers each have a hexagonal shaped cross section.

10. The exercise bench of claim 1, further comprising:

the one or more rear angled support bars being a first angled support bar and a second angled support bar;

a hinge coupling the first angled support bar and the second angled support bar to the left side rail and the right side rail;

a cross bar extending between the first angled support bar and the second angled support bar and coupled to the first angled support bar and the second angled support bar via a second hinge; and an adjustable support bar attached to the cross bar and extending to the left side rail and the right side rail and attached thereto via a third hinge, the adjustable support bar adjustable in length.

11. The exercise bench of claim 1, further comprising:

a back support brace coupled to the seat frame; and an adjustable bar attached to the back support brace and extending from the back support brace to a pivot connection positioned between the left side rail and the right side rail;

wherein the adjustable bar is configured to raise and lower the back support.

12. A combination of an exercise bench and a user attachment system, the combination comprising:

the exercise bench, having:

a base frame having a left side rail with a first channel and a right side rail with a second channel, the left and right side rails extending parallel to one another, and the base frame having a support system, the support system having a front bar and a rear bar extending substantially parallel to one another, one or more rear angled support bars extending from the rear bar to the left side rail and the right side rail, and one or more front angled support bars extending from the front bar to the left side rail and the right side rail;

a mid-frame having a plurality of wheels for engaging with the first channel and the second channel;

a seat frame coupled to the mid-frame;

a seat support coupled to the seat frame;

a back support coupled to the seat frame; and a plurality of receivers extending from one or more of the left side rail, the right side rail, the front bar, and the rear bar;

wherein the seat support and the back support are independently adjustable; and the user attachment, having:

a connector for engaging with one or more of the plurality of receivers; and one or more user engageable devices coupled to the connector;

wherein the one or more user engageable devices are configured to be engaged by a user during an exercise.

13. The combination of claim 12, further comprising:

the plurality of receivers including a pair of rail receivers extending from a rail attachment, the rail attachment secured to one of the left side rail and the right side rail;

the connector of the user attachment engaged with the pair of rail receivers;

an arm coupled to the connector via a rotational joint;

a handle adjustably coupled to the arm as the one or more user engageable devices; and a weight receiver adjustably coupled to the arm.

14. The combination of claim 12, further comprising:

the plurality of receivers including one or more receivers extending from a back brace, the back brace attached to the back support;

the connector of the user attachment engaged with the one or more receivers extending from the back brace, the connector extending outwardly from the back support;

a first side arm coupled to the connector via a first rotational joint;

a second side arm coupled to the connector via a second rotational joint;

a first pad and handle combination coupled to the first side arm;

a second pad and handle combination coupled to the second side arm;

a first weight receiver coupled to the first side arm; and a second weight receiver coupled to the second side arm.

15. The combination of claim 12, further comprising:

the plurality of receivers including a left side receiver and a right side receiver, the connector including a first side engaged with the left side receiver and a second side engaged with the right side receiver;

a floor support extending from the first side and the second side of the connector; and a foot plate adjustably coupled to the floor support.

* * * * *